US005606748A

United States Patent [19]

Fujiwara

[11] Patent Number: 5,606,748

[45] Date of Patent: Mar. 4, 1997

[54] FEMININE UNDERGARMENT WITH CALENDER

[76] Inventor: Shiomi Fujiwara, 11-12, Noke 1-chome, Setagaya-ku, Tokyo, Japan

[21] Appl. No.: 593,412

[22] Filed: Jan. 29, 1996

Related U.S. Application Data

[63] Continuation of Ser. No. 387,339, Feb. 13, 1995, abandoned.

[51] Int. Cl.[6] ..... A41B 9/00; A41D 27/08

[52] U.S. Cl. ..... 2/406; 2/400; 2/244; 40/107; 40/110

[58] Field of Search ..... 2/69, 69.5, 75, 2/80, 109, 110, 113, 114, 115, 104, 105, 106, 111, 112, 400, 401, 402, 403, 404, 405, 406, 407, 408, 409, 244, 243.1; 40/586, 107, 109, 110, 111, 112, 113, 114, 115, 116, 117, 118, 119, 120; 434/238, 247

[56] References Cited

U.S. PATENT DOCUMENTS

D. 286,220 10/1986 Irwin .
D. 306,090 2/1990 Burneka .
2,057,523 10/1936 Henry .
2,102,359 12/1937 Frieman .
2,868,293 1/1959 Kearse .
4,164,910 8/1979 Feiler .
4,354,282 10/1982 Langdon .
4,484,402 11/1984 Kebe .
4,820,164 4/1989 Kemper .

*Primary Examiner*—Jeanette E. Chapman
*Attorney, Agent, or Firm*—Spencer & Frank

[57] ABSTRACT

At the front waistband of a feminine undergarment, a clip holding band is equipped by sewing horizontal and vertical threads in a grid form, and below the clip holding band, a date portion is located in which numerals and heart shapes are printed in two lines. Both edges of the clip holding band are designed to be sewn as to extend from the date portion. At first, a gold heart-shaped clip is hooked on the right end portion and a silver heart-shaped clip is hooked on the left end of the clip holding band with a vertical pin and a horizontal pin. Moving the clip on to the clip holding band above the date of the date portion below and allowing the vertical pin tip end to protrude from the clip holding band enables the clip to indicate the date below. This enables the recording of the date when the period began and allows for the computation of the time until the next period begins.

7 Claims, 2 Drawing Sheets

FEMININE UNDERGARMENT WITH CALENDER

CROSS-REFERENCE TO RELATED APPLICATIONS

This application is a Continuation of U.S. application Ser. No. 08/387,339 filed Feb. 13, 1995, now abandoned, the disclosure of which is incorporated herein by reference.

BACKGROUND OF THE INVENTION

1. Field of the Invention

This invention relates to a feminine undergarment with a calendar, more particularly the wearer of the garment can easily tell the starting date of her next period.

2. Related Art

Conventionally, in order to tell the starting date of a woman's next period, methods for remembering the date until the next month, computing the cycle to determine the starting date, or recording previous dates in a memo or a notebook to find out the date of the start of the next period are generally known and have been popularly practiced.

However, it is not only difficult but also quite troublesome and complicated to remember the date of the next period, compute the cycle, and record the results.

SUMMARY OF THE INVENTION

This invention has been made to provide a feminine undergarment that can solve all these aforementioned troublesome problems.

In reference to this, a feminine undergarment with calendar according to the invention comprises: a date portion which is located below a waistband and on the front of the undergarment having upper and lower date lines with the upper date line indicating the first to the 15th day of a month and the lower date line indicating the 16th to the 31st day of a month with each date being identified by numerals or marks, a clip holding band which is located above the date portion and on the waistband of the undergarment with said band having at least a resilient thread which is stitched to more than 19 points on the waistband to provide 18 clipping positions with both ends of the clipping positions extending beyond the ends of the date portion, a first clip having a front panel and at least a vertical pointing hook provided on the back portion of the front panel with the edge of said hook protruding below the front panel, and a second clip which has a different color or configuration from the first clip having a front panel and at least a vertical pointing hook provided on the back portion of the front panel with the edge of said hook protruding below the front panel.

The first clip is used as a pointing mark for the dates of the first to 15th day of the month, and the second clip is used as a pointing mark of the dates of the 16th to 31st day of the month, either of the clips may be set to show the date of the onset of the period of the wearer, and the wearer can easily predict the next date of her period based on the date indicated by the clip and her periodic cycle.

DETAILED DESCRIPTION OF THE PREFERRED EMBODIMENT

Figure 1:
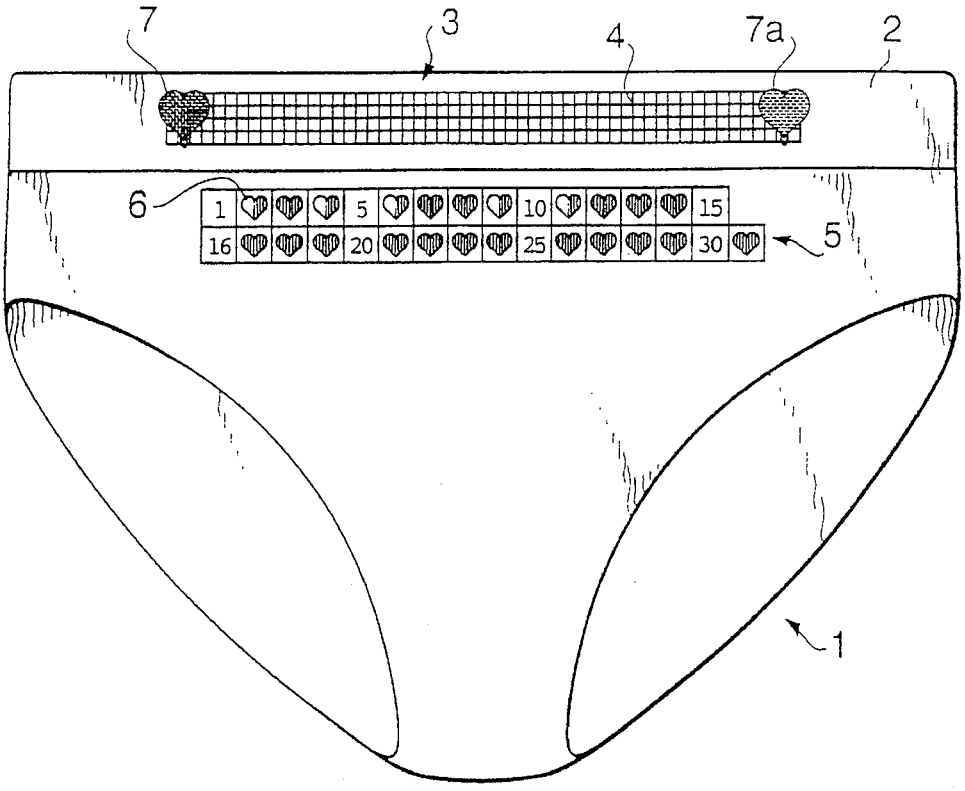
FIG. 1 is a front view of the embodiment of the invention.

Now referring to the drawings, an embodiment of this invention is described.

Figure 2:
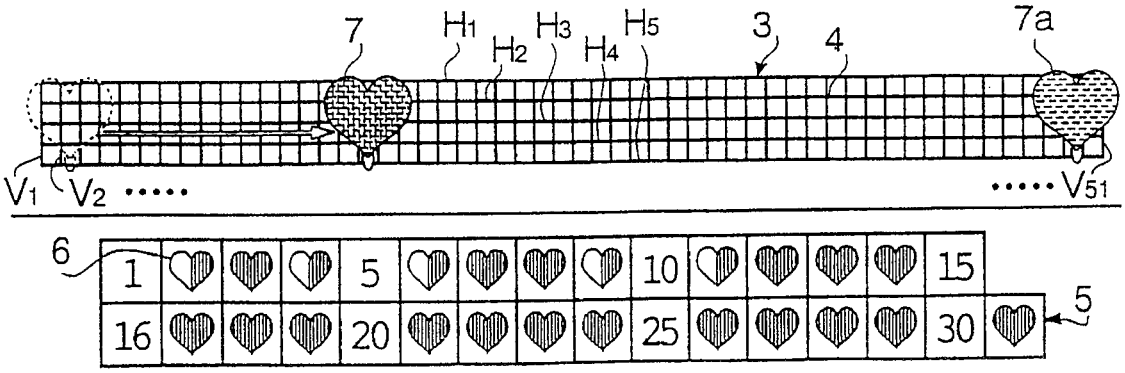
FIG. 2 shows a relationship of date portion and clips.
Figure 3:
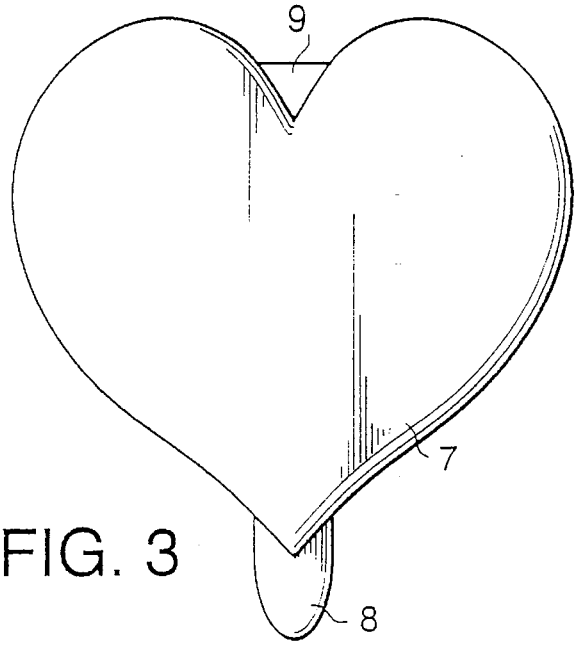
FIG. 3 is a front view of the embodiment of the clip of the invention.
Figure 4:
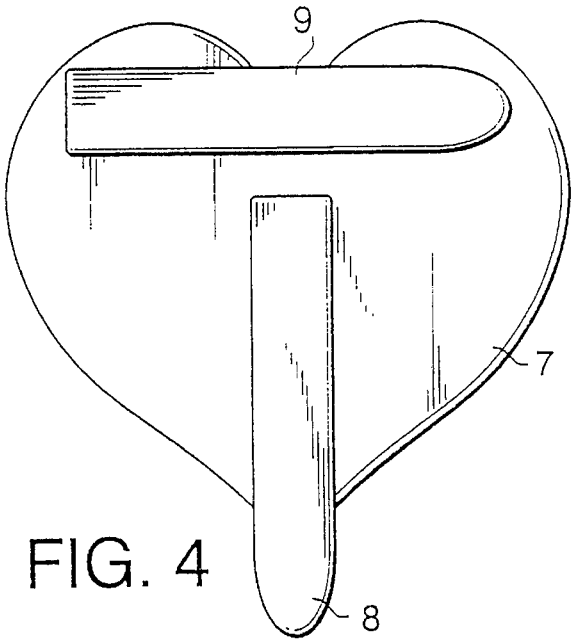
FIG. 4 is a back view of the clip of the invention.
Figure 5:
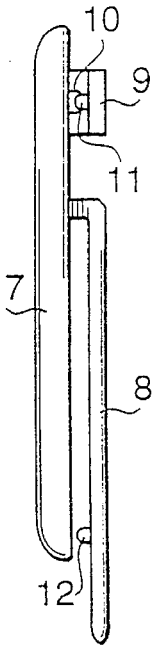
FIG. 5 is a side view of the clip of the invention.
Figure 6:
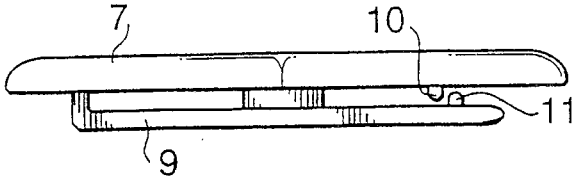
FIG. 6 is a plan view of the clip of the invention.

A clip holding band 3 is provided on a waistband 2 of a women's garment such as a pair of panties 1. As shown in FIG. 2, the clip holding band 3 consists of five resilient horizontal threads $H_1$, $H_2$, $H_3$, $H_4$ and $H_5$ such as rubber threads and fifty-five resilient vertical threads $V_1$ to $V_{51}$. Every crossing point of the horizontal and vertical threads is stitched to the waistband 2. Three horizontal loops of the clip holding band correspond to the width of a day of a date portion described below.

The date portion 5 is located below the waistband 2 and on the front of the garment. The date portion 5 has upper and lower date lines. The upper date line indicates the 1st to the 15th day of a month and the lower date line indicates the 16th to the 31st day of the month, and each date is identified by numerals or marks. In this embodiment numerals 1, 5, 10, 15, 16, 20, 25 and 30 are used to denote the corresponding days of a month. To denote the other days heart-shaped marks are used. And the heart-shaped marks corresponding to 2, 4, 6, 9 and 11th day of the month have different colored halves to indicate that February, April, June, September and November have fewer days than the other months. As clearly shown in FIG. 2, the both ends the clip holding band extend past each end of the date portion by three horizontal loops.

Referring to FIGS. 3 to 6, the embodiment of a clip will be explained. In this embodiment two clips which have the same configuration but are differently colored are used to indicate the onset of the last periodic cycle. The first clip 7 which is colored gold has a front panel portion and a vertical pointing hook 8 provided on back portion of the front panel, the lower edge of the hook 8 protrudes under the front panel. A protrusion 12 for sandwiching a horizontal thread or threads is provided at a place slightly above the pointing portion and facing the back of the front panel. In addition, a horizontal hook 9 is attached to the back the front panel above the vertical hook or pin 8. A protrusion 11 is provided on the unconnected end of the horizontal hook or pin 9 and a corresponding protrusion 10 is provided on the back of the front panel.

Two types of clips, one is a gold clip 7 which is used for the 1st to the 15th days of a month and the other is a silver clip **7*a*** which is used for the period from the 16th to the 31st days of a month, are hooked to both ends of the clip holding band at first.

The vertical clip 8 of the first clip 7 is inserted into the second loop position of horizontal threads $H_3$, $H_4$ and $H_5$ defined by the vertical threads $V_2$ and $V_3$, and the horizontal hook 9 of the clip 7 is inserted into the loops of the second and the third vertical threads ($V_2$ and $V_3$) which are defined by the upper most horizontal thread $H_1$ and the second horizontal thread $H_2$. The second clip **7*a* is located at the left end of the clip holding band in the same manner as the first clip 7**.

A date portion 5 is below the clip holding band 3, which is divided into two line, to which dates are represented by numerals and heart shapes. It is desirable to print numerals, but heart shapes are used in addition to numerals to indicate that February, April, June, September, and November are less than 31 days, and half-white heart shapes 6 are used for these short months.

To explain how to use the clips of this invention, the golden clip 7 is used for the 1st to the 15th days of a month, while the silver clip 7*a* is used for the 16th to the 31st days of a month.

For example, if the wearer's period begins on the 1st day of a month, the golden clip is moved on to 1 on the printed dates, that is, at the center loop of the three loops above the numeral, the vertical pin is inserted into the second horizontal loop which is defined by $V_5$ and $V_6$, and the tip end of the vertical pin is allowed to protrude from the 5th horizontal thread $H_5$. The protrusion end then points to the date 1 (the first day of the month). Then, the horizontal pin is inserted behind the two vertical threads $V_5$ and $V_6$ at the center of the square and held in such a manner that the vertical threads are sandwiched between the protrusion of the horizontal pin 11 and the pin 10 equipped on the back surface; this enables the clip to be completely fixed.

To set the pins to the 28th day, the silver clip is moved on to the 28th day of the date portion and is fixed in the same manner.

To compute the period of the cycle, when the above-mentioned dates are used for example, if the period begins on the 1st of a month and the next period begins on the 28th, the cycle begins from 1st and ends on 27th. This method of indicating the beginning of a period is simple as well as effective as a way to compute a periodic cycle.

Using the rubber threads in combination in the form of a letter T enables the force exerted on the clips 7 or 7*a* to counteract the deflection caused by movement. The best use of the synergism created by the interaction of the vertical pin 8 and the horizontal pin 9 prevents top and bottom deflection and firmly fixes the clips free from any fear of coming off from the vertical and/or horizontal rubber threads.

For the shape of clips 7, 7*a*, a heart shape is used in this invention, but it may be represented by any other shapes. As for the material, in this embodiment a synthetic resin coated with ABS resin is used to form gold and silver clips, but it may be a soft rubber material or may be any other material which does not produce any feeling of discomfort when the garment is worn. The clips proper 7, 7*a* and protrusions 10, the vertical pin 8 and its protrusion 12, and the horizontal pin 9 are formed as an integral unit by molding.

While the present invention has been described above only with respect to the embodiment thereof, its should of course be understood that the present invention should not be limited only to the embodiment but various changes or modifications may be made without departure from the scope of the present invention as defined by the claims.

What is claimed is:

1. A feminine undergarment including a waistband and a front side with a calendar comprising:

a date portion located below the waistband on the front side of the undergarment and having upper and lower date lines, wherein the upper date line indicates the first to the 15th day of a month and the lower date line indicates the 16th to the 31st days of a month and each date is identified by a numeral or a mark;

a clip holding band located above the date portion and on the waistband of the undergarment, the band having at least a resilient thread stitched to more than 19 points on the waistband to provide 18 clipping positions, wherein both ends of the clipping positions extend beyond the ends of the date portion;

a first clip having a first front panel with a first back portion and at least a first vertical pointing hook provided on the first back portion of the first front panel, the first hook having a first edge protruding below the first front panel; and a second clip having a second front panel with a second back portion, and at least a second pointing hook provided on the second back portion of the second front panel, the second hook protruding below the second front panel which has a different color or configuration from the first front panel;

wherein:

the first clip constitutes a pointing mark for the dates of the first to 15th day of the month on the upper date line, and the second clip constitutes a pointing mark of the dates of the 16th to 31st day of the month on the lower date line;

either of the clips may be set to show the date of the onset of the period of the wearer; and the wearer can easily predict the next date of the period based on the date indicated by the clip and her periodic cycle.

2. A feminine undergarment with calendar as set forth in claim 1, wherein the front panels of the clips are heart-shaped, and the first clip is gold colored, and the second clip is silver colored.

3. A feminine undergarment with calendar as set forth in claim 1, wherein the date portion is identified by the numerals 1, 5, 10, 15, 16, 20, 25 and 30 and marks.

4. A feminine undergarment with calendar as set forth in claim 3, wherein marks on the date portion representing the 2nd, 4th, 6th, 9th and 11th days of the month are different from other ones of the marks in order to show that the 2nd, 4th, 6th, 9th and 11th months, namely February, April, June, September and November, have fewer days than the other months.

5. A feminine undergarment with calendar as set forth in claim 1, wherein the resilient thread of the clip holding band is stitched to the waistband at 56 points in order for each three loops of the thread to corresponds to a day of the date portion, and the pointing hook of the clip is insertable into the a middle loop in order to show the corresponding date.

6. A feminine undergarment with calendar as set forth in claim 1, wherein the clip holding band has a plurality of horizontal threads and vertical threads crossing the horizontal threads at cross points, the cross points of the horizontal threads and the vertical threads being stitched to the waistband of the undergarment.

7. A feminine undergarment with calendar as set forth in claim 6, wherein the clip further has a horizontal hook attached on the back portion of the panel.

* * * * *